United States Patent [19]

Maloney

[11] 4,201,253

[45] May 6, 1980

[54] GAS PUMP LEVER BLOCKING MEMBER

[76] Inventor: Michael J. Maloney, 4800 Oxborough La., Minneapolis, Minn. 55437

[21] Appl. No.: 936,899

[22] Filed: Aug. 25, 1978

[51] Int. Cl.[2] ..... B65B 1/04; B65B 3/00; B67C 3/00

[52] U.S. Cl. ..... 141/392; 251/90; 251/107; 403/33

[58] Field of Search ..... 403/405, 409, 410, 33; 141/392, 209, 198; 74/526; 251/90, 107, 111

[56] References Cited

U.S. PATENT DOCUMENTS

| | | | |
|---|---|---|---|
| 3,529,489 | 9/1970 | Schaeffer | 74/526 |
| 3,805,857 | 8/1974 | Johnson et al. | 141/198 X |
| 4,095,629 | 6/1978 | Jordan | 251/90 X |

FOREIGN PATENT DOCUMENTS

| | | | |
|---|---|---|---|
| 667947 | 8/1963 | Canada | 141/209 |

*Primary Examiner*—Wayne L. Shedd
*Attorney, Agent, or Firm*—Merchant, Gould, Smith, Edell, Welter & Schmidt

[57] ABSTRACT

A gas pump lever blocking member including an elongated member with a first end adapted to engage the lever and a second end adapted to engage the lever guard in a plurality of positions corresponding to varying gas flow rates through the pump. The elongated member has a stepped portion proximate its second end defining a plurality of guard engagement surfaces lying in planes disposed along an elongation axis of the member.

2 Claims, 4 Drawing Figures

GAS PUMP LEVER BLOCKING MEMBER

BACKGROUND OF THE INVENTION

The present invention relates broadly to a blocking member for holding a gas pump valve open and in particular to a gas pump lever blocking members wherein the pump valve can be held open in a plurality of positions corresponding to various rates of flow through the pump.

Conventional prior art gas pumps include a nozzle with a housing in which is mounted a valve apparatus for regulating the flow of fuel through the nozzle. The nozzle is provided with a manually operable lever whereby the valve apparatus can be opened to permit the discharge of fuel from the nozzle. The lever is normally biased, for example, by a spring means, to a position wherein the valve apparatus is closed. Typically, prior art nozzles also include an automatic closing device such that fuel flow through the nozzle will be terminated when the tank is filled thereby preventing fuel overflow and spillage. Such automatic closure apparatus is typically independent of the manual operation of the lever. Additionally, some gas pump nozzles are provided with a means attached thereto to hold the lever in the open position against the biasing force that tends to close the valve. Such means typically is a bar mounted to the nozzle with several notches therein in which is received the end of the lever. Another prior art lever retention means is a stop pivotally attached to the lever for engagement with a plurality of stop surfaces on the guard or handle surrounding the lever.

Some gas pump nozzles are not provided with any means for retaining the lever in the open position. Additionally, in self-service gas station operations, it is not uncommon for the station owner to simply remove the lever retention means from the nozzle. Thus, the vehicle owner utilizing the self-service station finds that he must continually apply manual pressure to the lever to hold the nozzle open until the gas tank is filled.

Additionally, it is not uncommon for the lever to simply slip out of the prior art retention means thereby closing the fuel valve and shutting off fuel flow. Under continued use for extended lengths of time due to mechanical wear and tear the prior art retention means become less and less effective. When the lever does in fact slip from the grasp of the prior art retention means it is a nuisance to the gas station attendant or operator who at the time may be performing other maintenance functions concerning the vehicle.

It is desirable, therefore, to have a device that holds the gas pump nozzle open so that the vehicle operator or station attendant can perform other tasks, such as checking the oil level of the vehicle, et cetera. It is also desirable to have such a blocking member device that can be conveniently carried by an individual vehicle operator.

The present invention provides these desirable features in that it is a gas pump lever blocking member that positively retains the lever in the open position against a closing biasing force. The blocking member of the present invention is designed so that it can be positioned to hold the lever open in a plurality of different positions corresponding to varying rates of fuel flow through the gas pump nozzle. Although the present invention can be utilized by the station attendant to eliminate the problems associated with the prior art retention means discussed above, it is particularly useful to the individual motor vehicle operator and can be easily carried in the vehicle and made readily accessible for use thereof.

SUMMARY OF THE INVENTION

The present invention is a blocking member for maintaining a gas pump valve open. The pump includes a valve actuating lever that is normally biased closed and which has a lever guard or handle disposed thereabout. The blocking member is an elongated member with first and second ends disposed along an elongation axis. The first end has a first means for engaging the gas pump lever and the elongated member includes a second means disposed proximate the second end for engaging the lever guard whereby the lever is held open against the closing biasing force.

In the preferred embodiment, the second means for engaging the lever guard include a plurality of guard engaging members that are disposed axially along the elongation axis of the elongated member between the first and second ends thereof. The rate of fuel flow through the gas pump nozzle is determined by the particular member that engages the guard.

In one embodiment of the present invention, the elongated member has a stepped portion disposed generally proximate its second end. The stepped portion defines a plurality of guard engagement surfaces that lie generally in planes transverse to the elongation axis and spaced apart along the elongation axis. The engagement surfaces face the second end of the elongated member and the elongated member is displaced with the first end contacting the lever and one of the engagement surfaces contacting the guard. A permanent magnet may be affixed to the elongated member to facilitate mounting of the member on a metallic surface such as the vehicle dashboard or the gas pump itself.

The blocking member of the present invention is sized to engage the lever generally proximate the midpoint of the lever as opposed to at the end of the lever. The closing biasing force is in fact the force which functions to retain the wedge between the lever and the guard, whereas in the prior art retention means the biasing force acted on the retaining member to in effect provide a force component to swing the retaining member out of engagement with the lever or the guard.

Thus, the present invention provides a blocking member which positively retains the gas pump valve open in a plurality of positions corresponding to the particular fuel flow rate desired. The blocking member of the present invention substantially eliminates the problems of the prior art retention means that are subject to nuisance closings of the gas pump nozzle. The present invention is conveniently carried in the vehicle or by the vehicle operator. The blocking member frees the vehicle operator or the gas station attendant using it so that other maintenance checks concerning the vehicle can be made while the fuel takn is being filled. These and other advantages of the present invention will become apparent with reference to the accompanying drawings, detailed description of the preferred embodiment, and claims.

DETAILED DESCRIPTION OF THE PREFERRED EMBODIMENT

Figure 1:
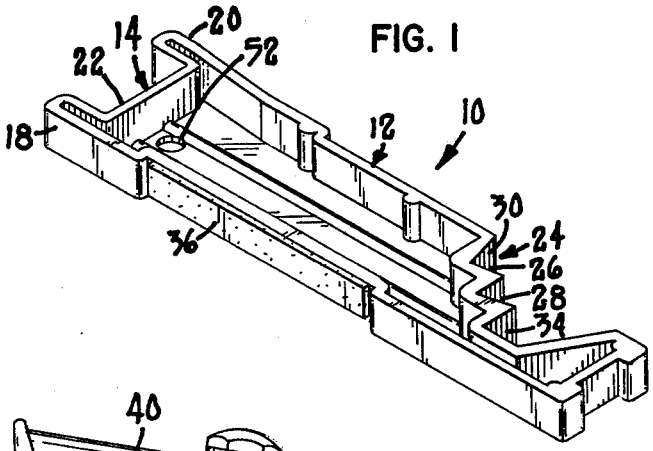
FIG. 1 is a view in perspective of the gas pump lever blocking member of the present invention.
Figure 2:
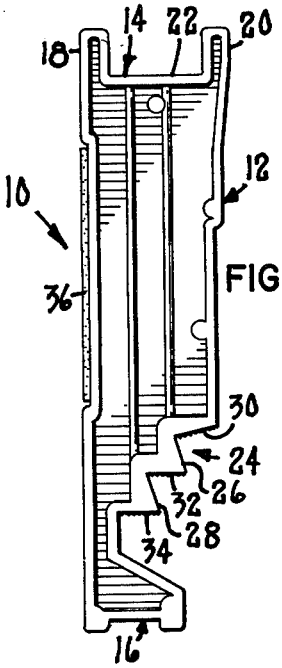
FIG. 2 is a plan view of the gas pump lever blocking member of the present invention.

Referring to the drawing, wherein like numerals represent like parts throughout the several views, the gas pump lever blocking member of the present invention is designated generally as 10. Blocking member 10 is an elongated member 12 having an elongation axis along which are disposed a first end 14 and a second end 16. First end 14 has a pair of projecting members 18 and 20 which are generally parallel to the elongation axis of member 12. Projecting members 18 and 20 in conjunction with an engagement surface 22 on first end 14 define a notch or recess in which is received the gas pump lever as will be described in more detail hereafter.

Means are provided on elongated member 12 for engaging the lower gas pump handle member or lever guard. In the preferred embodiment, elongated member 12 has a stepped portion 24 on one side thereof which defines a plurality of notches 26 and 28 that are axially disposed with respect to the elongation axis of member 12. Stepped portion 24 provides a plurality of engagement surfaces 30, 32, and 34 which generally lie in planes normal to the elongation axis and axially disposed along said axis. Stepped portion 24 is preferably formed in elongated member 12 proximate second end 16. The significance of the positioning of stepped portion 24 on elongated member 12 will become more apparent hereafter. It is understood that stepped portion 24 simply represents one means of providing a plurality of engagement surfaces 30, 32, and 34 axially disposed along elongated member 12. Alternative structures which provide similarly axially disposed engagement surfaces are also contemplated within the spirit and scope of the present invention.

Affixed along the opposite side of elongated member 12 from stepped portion 24 is an elongated magnet 36. Magnet 36 may be adhered to elongated member 12 by any convenient means such as a suitable adhesive. Magnet 36 allows wedge 10 to be conveniently mounted to a metal surface, such as the dashboard of a vehicle whereby blocking member 10 is readily accessible when needed.

Figure 3:
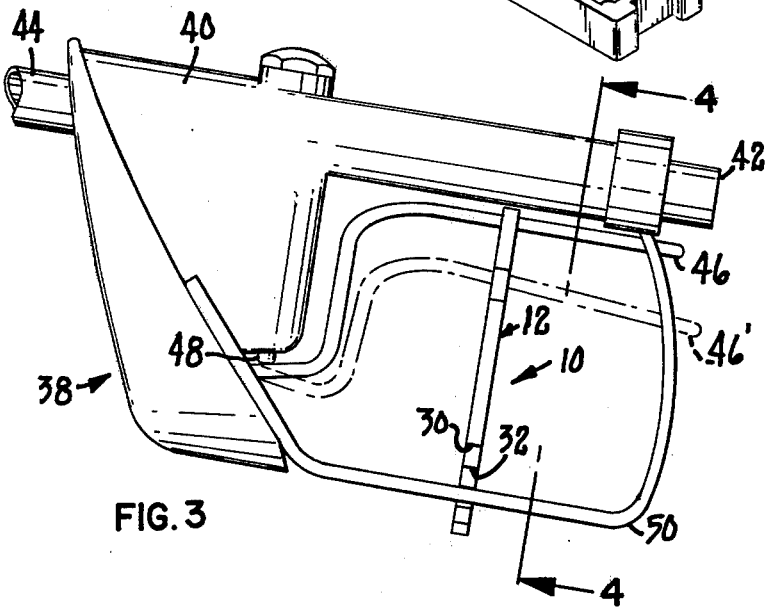
FIG. 3 is a view illustrating the operation of the gas pump lever blocking member of the present invention in conjunction with a conventional prior art gas pump nozzle.
Figure 4:
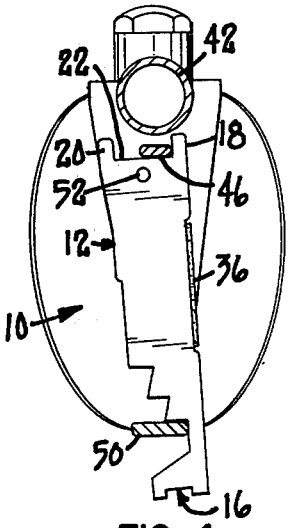
FIG. 4 is a sectional view taken generally along lines 4—4 of FIG. 3.

FIGS. 3 and 4 illustrate the operation of gas pump lever blocking member 10. A portion of a gas pump nozzle, incorporating the valve mechanism, is shown generally at 38. Gas pump nozzle 38 includes a housing 40 which contains the valve mechanism that includes an automatic shutoff means to prevent gas overflow from a filled tank. Nozzle 38 has an end 42 connected by a flexible hose (not shown) to the gas pump. An opposite end 44 of nozzle 38 has an extension (not shown) which is placed into the gas tank opening. Nozzle 38 includes a manually operable lever 46 which is movable between a fully closed position as shown by the dashed lines at46' to the fully opened position illustrated in FIG. 3. Lever 46 is pivotally mounted to housing 40 and is in contact with a valve actuating rod, the end of which is shown at 48. Rod 48 is typically spring biased to urge lever 46 toward the fully closed position at 46'. Pump 38 also includes a handle or lever guard 50 which is disposed generally about lever 46. It will be understood that gas pump nozzle 38 is a conventional prior art structure and does not form a part of the present invention. The present invention of gas pump lever blocking member 10 is specifically designed to be used with any such conventional prior art gas pump apparatus.

When it is desired to fill one's gas tank while at the same time performing other activities, such as other preventive maintenance checks on the automobile or vehicle, the extension from end 44 is placed within the opening to the gas tank. Lever 46 may then be manually operated against the spring biasing force thereby opening the valve permitting gas flow into the tank. Blocking member 10 is positioned such that lever 46 is received within the notch or recess formed by projecting members 18 and 20 and in contact with engagement surface 22. One of engagement surfaces 30, 32, and 34 is then placed into contact or engagement with lever guard 50, as illustrated specifically in FIG. 4. Blocking member 10 thereby holds lever 46 in the open position against the biasing force tending to urge lever 46 to the closed position at 46'. The selection of a particular engagement surface 30, 32 or 34 is dependent upon the rate at which one wishes to fill the gas tank. For example, it can be understood that engagement surface 30 would correspond to a relatively slow rate of fill in comparison with engagement surface 34. Engagement surface 32 may be considered an intermediate or medium rate of fill. Preferably, elongated member 12 is sized an engagement surfaces 30, 32 and 34 are axially positioned along its elongation axis such that engagement surface 34 generally corresponds to maximum fill rate of a typical prior rate gas pump nozzle 38.

As previously mentioned, magnet 36 is provided as a convenient means for attaching blocking member 10 to the dashboard or other metallic part of the vehicle so that blocking member 10 is conveniently accessible. An aperture 52 may be provided in member 12 so that blocking member 10 can also be carried on a key chain and thus also made conveniently accessible. In the preferred embodiment, blocking member 10 is molded of a suitable plastic material. It will be understood, however, that any sufficiently rigid material may be utilized within the spirit and scope of the present invention.

From the above description, it can be seen that the present invention is a convenient means to facilitate filling a gas tank while the vehicle operator performs other maintenance and inspection services. Blocking member 10 is particularly convenient in self-service gas pump operations. Gas pump nozzle 38, as previously mentioned, has an automatic shutoff which is independent of the operation of lever 46. Thus, blocking member 10 may be utilized as described herein without concern of a tank overflow. Blocking member 10 is made readily accessible to the vehicle operator and provides convenient means to fill his gas tank, particularly at self-service stations that are rapidly increasing in number as the cosrt of fuel also increases.

What is claimed is:

1. A gas pump lever blocking member for use with a gas pump having a nozzle, a valve for regulating gas flow through the nozzle, a manually operable lever arm to open the valve, means for biasing the lever arm in a position whereby the valve is normally closed, and a lever arm guard disposed about the leverarm, comprising:

(a) an elongated member having an elongation axis, first and second ends disposed along said elongation axis, and opposite side portions, one of said side portions having a plurality of notches formed therein and spaced apart along said elongation axis, each of said notches defining engagement surfaces facing generally toward said second end of said member, said engagement surfaces disposed to engage the inner surface of the lever guard; and (b) a pair of members projecting from said first end and spaced apart at a distance greater than the width of the lever arm to define a slot sized to receive the valve actuating lever arm whereby the lever arm is held in a valve opening position against the biasing means with said elongated member releasably engaged between the lever guard and the lever arm with said first end of said elongated member engaging the lever arm at a point spaced apart from the end of the lever arm.

2. A blocking member in accordance with claim 1 comprising a permanent magnet affixed to one of said side portions of said elongated member.

* * * * *